United States Patent [19]

Büchel

[11] 4,068,992

[45] Jan. 17, 1978

[54] APPARATUS FOR MANUFACTURING TILES

[75] Inventor: Arthur Büchel, Balzers, Liechtenstein

[73] Assignee: Interoptik Handelsanstalt, Liechtenstein

[21] Appl. No.: 681,408

[22] Filed: Apr. 29, 1976

Related U.S. Application Data

[63] Continuation-in-part of Ser. No. 476,866, June 6, 1974, abandoned, which is a continuation-in-part of Ser. No. 227,859, Feb. 22, 1972, abandoned.

[30] Foreign Application Priority Data

Mar. 1, 1971 France ..... 71.06908

[51] Int. Cl.[2] ..... B28B 11/00; B28B 11/12

[52] U.S. Cl. ..... 425/91; 425/92; 425/308; 425/382 R; 118/315

[58] Field of Search ..... 425/91, 92, 381, 382, 425/308; 264/148, 211; 118/42, 315

[56] References Cited

U.S. PATENT DOCUMENTS

| | | | |
|---|---|---|---|
| 452,466 | 5/1891 | Doy | 425/197 |
| 2,149,920 | 3/1939 | Kretchmer | 425/381 X |
| 3,190,781 | 6/1965 | Metz | 156/500 |
| 3,572,257 | 3/1971 | Minor et al. | 425/382 X |
| 3,834,849 | 9/1974 | Supron et al. | 425/206 |

*Primary Examiner*—Robert L. Spicer, Jr.
*Attorney, Agent, or Firm*—Stevens, Davis, Miller & Mosher

[57] ABSTRACT

An apparatus for manufacturing tiles by extrusion of clay or a similar material comprising a die adapted with a number of spaced apart pivotable rigid blades which are arranged such as to equalize the output speeds of several superposed layers of extruded material. Means are also provided substantially in the planes of the blades downstream of the outer ends thereof for projecting a pulverized powder product at right angles to the direction of extrusion into interstices between the layers. Impermeable coatings are added to the outer surfaces of the superposed layers and the assembly is then cut into piles of tiles which can then be delivered into an oven for baking, the heat ensuring removal of the impermeable coating and the separation powder product.

9 Claims, 6 Drawing Figures

FIG. 1
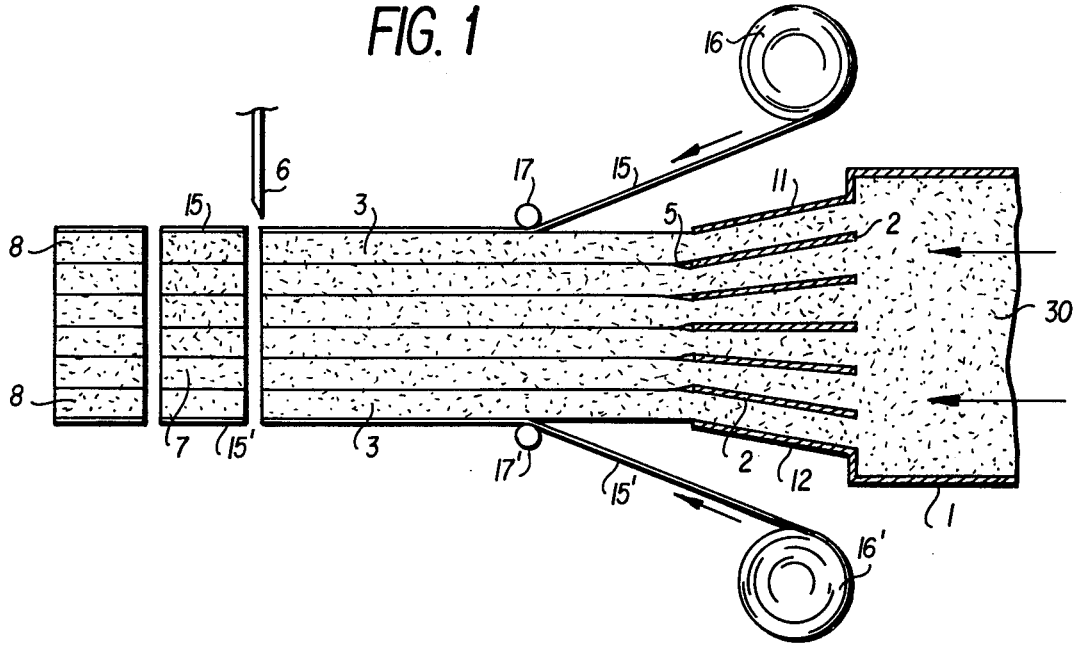
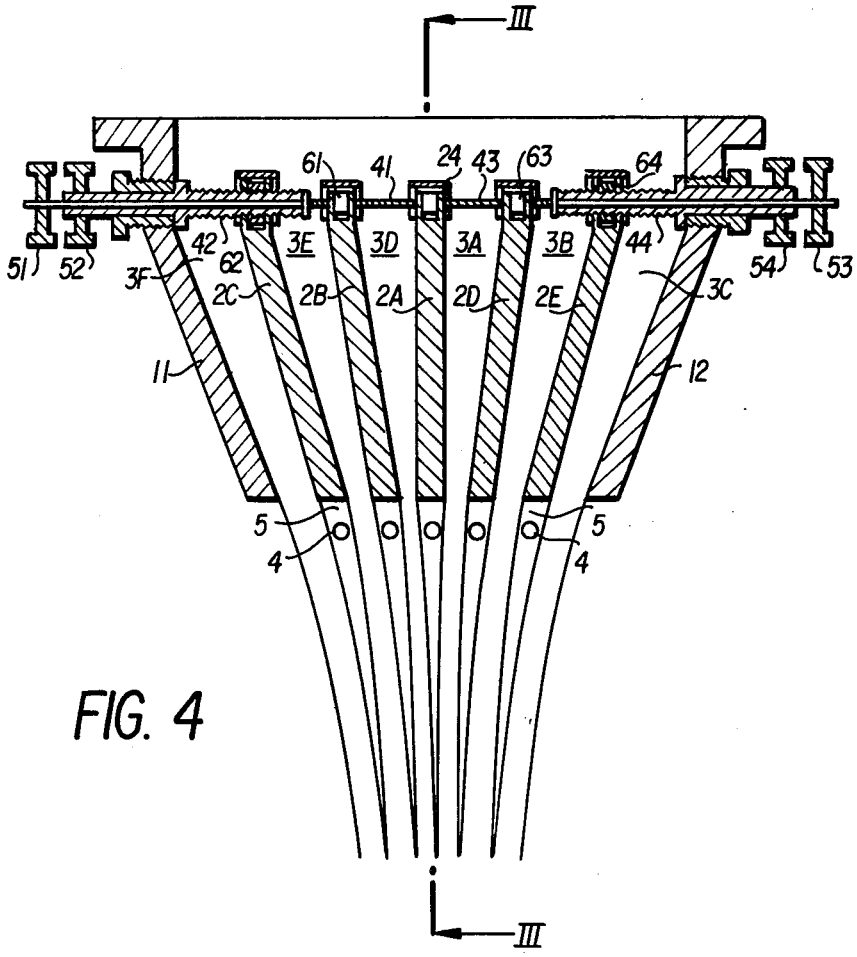
FIG. 4

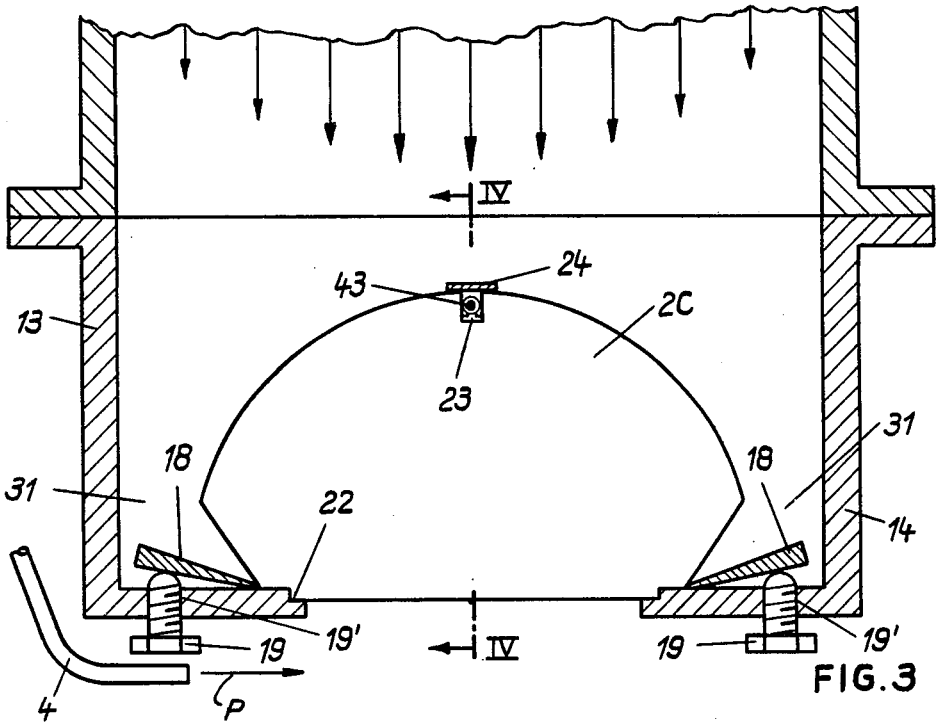
FIG. 3
FIG. 2
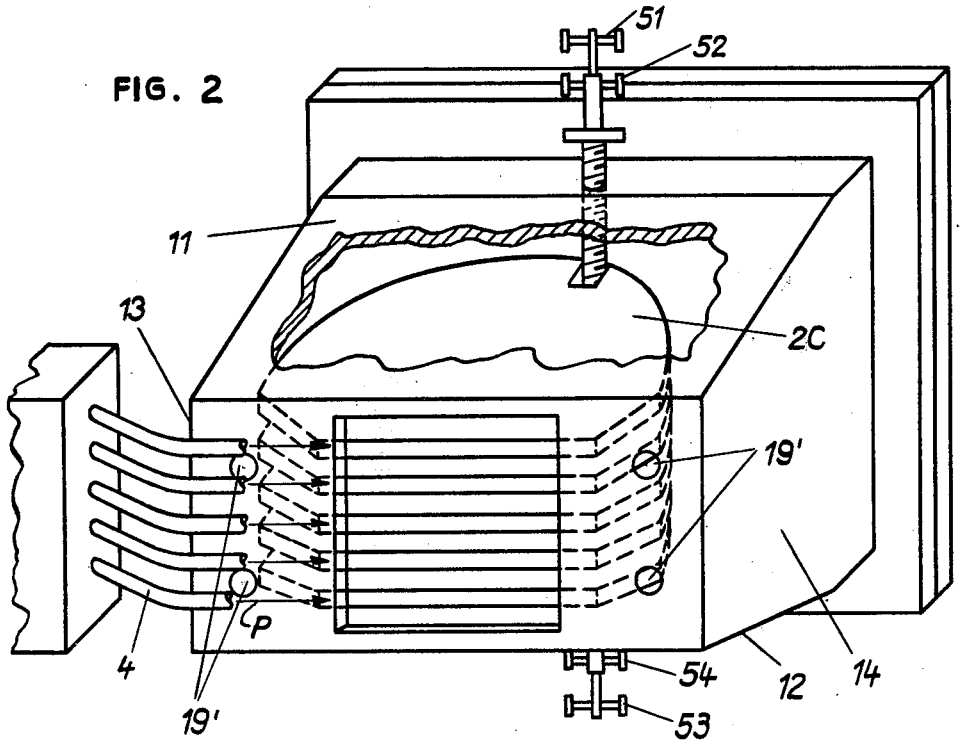

APPARATUS FOR MANUFACTURING TILES

CROSS-REFERENCE TO RELATED APPLICATIONS

This application is a continuation-in-part of my copending application No. 476,866 filed June 6, 1974, now abandoned, which in turn is a continuation-in-part of my application No. 227,859 filed Feb. 22, 1972 now abandoned.

This invention relates to the manufacture of tiles and more particularly to an apparatus for manufacturing tiles by extrusion of clay or a similar material.

At the present day in the building trade, ceramic or other decorative tiles are frequently used to improve the aspect of the surfaces of constructions.

It is known to manufacture flat bricks of baked clay in an extruding machine producing two superposed extruded layers of clay, the interfaces of which have voids for enabling subsequently after baking, to divide the extruded brick into two half-bricks. The interfaces of such half-bricks are not smooth and cannot serve as decorative surfaces from the aesthetic point of view. This problem prevents the extrusion of more than two superposed layers.

Another problem to be solved in the extrusion of clay is to ensure a uniform speed of the extruded superposed layers. Now, a uniform speed of extrusion is essential to prevent deformation of the layers.

The above problems are solved by the invention which provides an apparatus enabling a great number (for example six, eight..) of tiles of baked clay or similar material to be made simultaneously with all flat and aesthetic surfaces which can be used for decorative purposes.

According to a feature of the invention there is provided an extruding apparatus comprising a die having a number of spaced apart rigid blades for dividing the extruded material into superposed layers, said blades being located upstream of the die outlet in planes which are converging towards said die outlet, said blades being mounted to be pivotable about their outer ends; means for pivoting individually said blades about their outer ends; means at the side edges of the blades for ensuring an adjustable lateral feed of material to be extruded, means located substantially in the planes of said blades downstream of the outer ends thereof for projecting a powder product at right angles to the direction of extrusion into interstices between the layers; means for placing an impermeable coating on the outer surfaces of the assembly of extruded superposed layers; and means for cutting said assembly thus obtained into separate piles of superposed tiles.

According to another feature of the invention, the blades have a greater length along the direction of extrusion at their central portion than at their side edges, these blades moreover having their side edges spaced apart by an appropriate distance from the side walls of the die to form means for providing a lateral feed of the material to be extruded. Adjustment of said lateral feed is made by means comprising flap-like members adapted to be angularly adjusted to adjust the section available for the lateral passage of the material to be extruded.

The objects and features of the invention will be better understood from a consideration of the description which follows when taken in conjunction with the accompanying drawings, in which:

FIG. 1 is a schematic cross-sectional view of the end portion of an extruding apparatus according to the invention;

FIG. 2 is a perspective view of the apparatus of FIG. 1;

FIG. 3 is a cross-section taken alone line III—III of FIG. 4, showing the mounting of the blades;

FIG. 4 is a cross-section taken along line IV—IV of FIG. 3;

Figure 5:
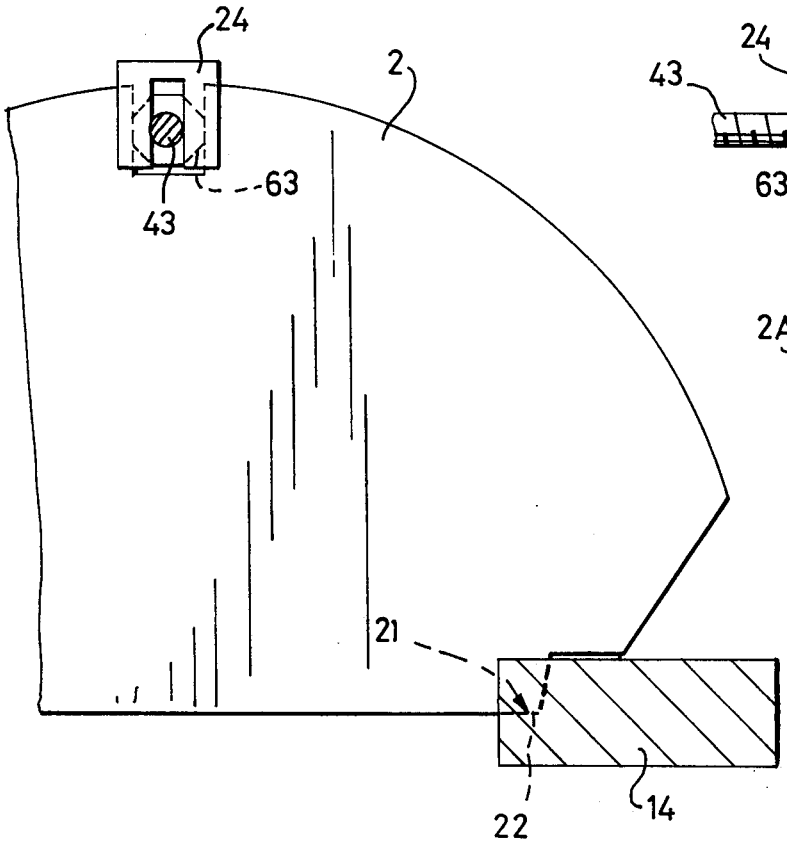
FIG. 5 is an enlarged view of a portion of FIG. 3.
Figure 6:
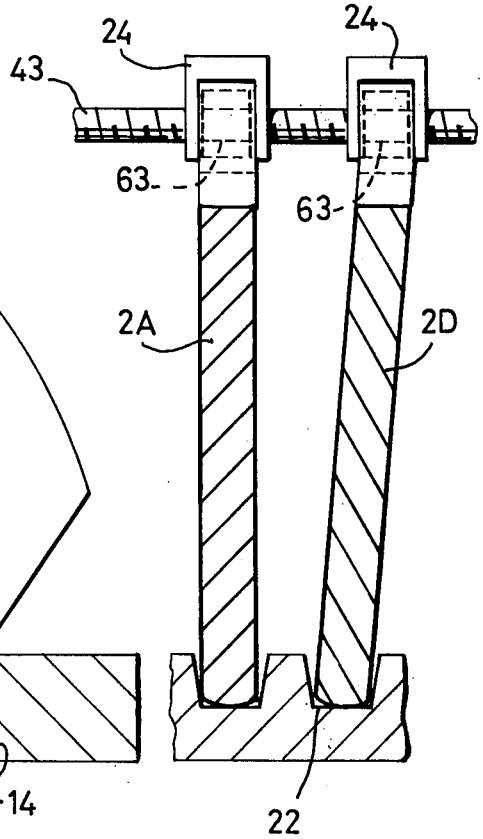
FIG. 6 is an enlarged side view of two blades in the apparatus of FIG. 4.

Referring to FIG. 1 there is shown in cross-section the end portion of a die 1 arranged according to the invention in a brick extruding machine. The converging upper and lower walls of the die 1 are designated as 11 and 12 respectively. In the outlet of die 1 are provided a number of spaced apart rigid blades 2 which divide the extruded material 30, clay, into a number of superposed layers 3. The purpose of blades 2 will be discussed later.

Means 4 (represented schematically as nozzles in FIGS. 2 and 4) are provided substantially in the planes of the blades 2,3 downstream of the outer ends thereof to deliver a pulverized powder product flowing along the arrows P, at right angles to the direction of extrusion in the interstices 5 formed between the adjacent layers. This product ensures the separation of the layers of clay and prevents the humid layers from welding together. This product is selected to have the effects of causing the adherence of the dried piles of tiles which enables these piles to be piled onto trucks, in the same manner as bricks, for delivery into an oven and further to have the property of being completely removed after baking of the tiles. The baking thus eliminates this product and provides non-welded tiles. A particularly suitable product is polyvinyl acetate powder, possibly with a suitable added percentage of polyvinyl alcohol.

At the outlet of the die, the layers 3 are sectioned by cutter means 6 into piles of tiles 7. In order to avoid warping of the upper and lower tiles upon drying, impermeable coatings are disposed on the upper and lower surfaces of the assembly of superposed layers. Thereby, the evaporation of each tile will take place only by its lateral surfaces and all of the tiles will dry in the same manner to give flat dried tiles. In the example of FIG. 1, use is made of sheets 15 and 15' of aluminium taken from reels 16 and 16' respectively and applied onto the upper and lower surfaces of the assembly of extruded layers by rollers 17 and 17' respectively. It is also possible to use oiled paper, cellophane or, generally speaking, any material which can be removed by combustion in the oven and which can be cut by the cutter means 6 at the same time as the layers of clay.

After cutting and drying, the piles of dried tiles are delivered to an oven and baked whereupon the impermeable coatings and the separation powder material are removed to provide piles of separate tiles 8.

The blades 2, made for example of steel, are converging in the direction of extrusion and they have a general shape as shown in FIG. 3. Steps 21 in the blades at their outer ends rest in notches 22 at the outlet of the die. These notches ensure that the blades are equally spaced at the outlet of the die, thereby ensuring extrusion of layers having the same thickness. Considering the direction of extrusion, they have a greater length at their central portion than at their side edges. The effect of blades 2 is to cause frictional drag on the extruded material. Said frictional drag acts for a greater time as the blade length is greater, thereby resulting in a greater drag at the center of the extruded material 30 than at the edges thereof. Since the extruded material 30, due to the frictional drag caused by the walls of the die 1, has a lower speed at its edge portion than at its central portion (see FIG. 3), the greater drag caused by the blades 2 is produced in the region where the extrusion speed is greater.

Each blade has at its inner end a notch 23 for connection of the blade to a control means serving to adjust the respective angular position of the blade. FIG. 4 shows four coaxially extending partially-threaded rods 41,42,43,44. Rods 41 and 43 extend from the central blade 2A toward the walls 11 and 12 respectively and in turn support the rods 42 and 44 respectively. Each rod controls one blade, the central blade 2A having no need for being controlled. Each rod engages with a nut attached to a respective blade in the notch 23 thereof. The nuts are secured in said notches 23 by means of clips 24 which hold them in position as shown more clearly in FIG. 5. As shown in FIG. 4, rod 41 engages with nut 61 for controlling blade 2B, rod 42 engages with nut 62 for controlling blade 2C, rod 43 engages with nut 63 for controlling blade 2D and rod 44 engages with nut 64 for controlling blade 2E. Each rod has a control knob, 51,52,53,54 for manually rotating the respective rods. Rotating knob 53, for instance, causes the nut 63 and the inner end of blade 2D to move axially along the threaded rod 43. Because the blade at its outer end rests in the notches 22 at the die outlet (see FIG. 3), movement of the inner end of blade 2D along the rod 43 results in the blade being pivoted in the notches 22 about their outer end thereof, thereby varying the inclination of the blade 2D relative to the adjacent ones. The angular position of each of the blades 2B, 2C, 2D and 2E can be adjusted individually. Such an adjustment of the respective angular positions of blades 2 is effective to control the flow rates and to equalize the output speed for the various extruded layers. If for example the layer 3A moves too slowly, the spacing between the inner end of blade 2E and the lower wall 12 of the die is increased by causing blade 2E to pivot about its outer end whereby the speed of layer 3A is increaased at the outlet of die 1. During this adjustment, the inner end of blade 2E moves closer to the inner end of blade 2D and will cause a slowing of the flow rate of layer 3B. The blade 2D should in turn also be acted upon to move its inner end away from the inner end of blade 2E, by an amount lesser than that of the inner end of blade 2E from the lower wall 12 thereby to increase the speed of said layer 3B at the die outlet. The same applies to the other layers. It should be noted that due to the mounting of the blades at their outer ends, where the lateral steps 21 thereof pivot in the notches 22 (see FIG. 5), the thickness of the extruded layers 3 at the outlet remains unchanged. Since the outer layers 3A and 3F tend principally to move slower than the central layers due to the peripheral slowing effect of the walls of the die the threaded rods are advantageously given screw threads of different pitches. The control knobs may be operated simultaneously or separately.

It is to be understood that the threaded rods may be arranged to extend parallely to each other instead of extending coaxially as illustrated in FIG. 4.

The presence of the blades 2 tends to slow the flow rate of the extruded material, principally near the side walls 13 and 14 of the die (see FIG. 3). To reduce said lateral slowing effect, the blades 2 are spaced apart by a certain distance from the side walls 13 and 14. Lateral channels 31 are thereby provided for enabling the laminar flow of material in the vicinity of the side walls to be varied relative to the general flow of material by suitable means. In the illustrative embodiment of FIG. 3, said means consist of flap-like members 18 whose angular position relative to the direction of extrusion is adjustable by means of screws 19 in holes 19' (FIG. 2) in order to vary the passage-way section for the extruded material. When the flap members 18 are held in a position for which the angle between said members and the direction of extrusion is maximum, the passage-way section is maximum and consequently the slowing effect along the side walls is minimum. As said angle decreases by the screws 19 being screwed, the passage-way section, also decreases whereby the slowing effect along the side walls increases. In FIG. 3, the members 18 are shown in a position for which the lateral slowing effect is nearly minimum. In this way, adjusting the angular position of the flap members 18 by means of the screws 19 makes it possible to vary the lateral flow rate of the extruded material in accordance with the flow rate at the central portion of the flow of material, thereby to ensure the flow rate to be substantially uniform throughout the width of the passageway at the die outlet.

I claim:

1. An apparatus for manufacturing tiles by extrusion of clay or a similar material, comprising a die having therein a number of spaced apart rigid blades for dividing the extruded material into a plurality of superposed layers, said blades being located upstream of the die outlet in planes which converge towards said die outlet, said blades being mounted to be pivotable about their outer ends; means attached to said blades for pivoting individually said blades about their outer ends; means at the side edges of the blades for ensuring an adjustable lateral feed of material to be extruded; means located substantially in the planes of said blades downstream of the outer ends thereof for projecting a powder product at right angles to the direction of extrusion into interstices between the layers; means for placing impermeable coatings on the outer surface of an assembly of extruded superposed layers; and means for cutting such an assembly, and impermeable coatings, into separate piles of superposed tiles.

2. The apparatus according to claim 1, wherein the blades have a greater length along the direction of extrusion at their central portion than at their side edges.

3. The apparatus according to claim 1, wherein the blades at their outer ends have lateral steps engageable into notches provided in the walls of the die.

4. The apparatus according to claim 1, wherein the means for pivoting the blades comprise a series of threaded rods in engagement with nuts which are connected with the blades, said rods having different screw pitches.

5. The apparatus according to claim 1, wherein the blades have their side edges spaced apart by an appropriate distance from the side walls of the die to form means for providing a lateral feed of the material to be extruded.

6. The apparatus according to claim 5, further comprising means for adjusting said lateral feed of material, said adjusting means comprising flap-like members adapted to be angularly adjusted to adjust the section available for the lateral passage of the material to be extruded.

7. The apparatus according to claim 1, wherein the means for projecting powder comprises means for projecting powdered polyvinyl acetate with an appropriate quantity of polyvinyl alcohol.

8. The apparatus according to claim 1, wherein said placing means comprises means for placing an impermeable coating formed of sheets selected from the group consisting of aluminium, oiled paper and cellophane.

9. An apparatus for manufacturing tiles by extrusion of clay or similar material, comprising an extrusion die (1) for receiving material (30) which is forced under pressure between a set of spaced-apart rigid blades (2) located within the die for dividing extruded material into superposed layers (3), said blades converging towards a die outlet and being provided with means (41,42,43,61,62,63) for pivoting said blades individually about their ends disposed at the inlet of the die, lateral channels (31) between said blades and the side walls (13,14) of the die enabling a supplementary feed of material where the flow rate of the extruded material is slow, adjustable means (18,19) for controlling the amount of said supplementary feed, means (4) for projecting a powder product between layers of extruded material at right-angles to the direction of extrusion for ensuring separation of adjacent layers thereof, and means (16,17) for placing an impermeable coating on the outer surfaces of extruded superimposed layers, and cutting means (6) for separating coated superimposed layers into separate piles of superimposed tiles.

* * * * *